United States Patent [19]

Long et al.

[11] Patent Number: 4,833,735

[45] Date of Patent: May 30, 1989

[54] HELMET SUSPENSION WITH INTEGRATED CROWN STRAPS AND HEADBAND

[75] Inventors: Richard J. Long, Lake Ariel; James J. Petruzella, Carbondale, both of Pa.

[73] Assignee: Gentex Corporation, Carbondale, Pa.

[21] Appl. No.: 68,836

[22] Filed: Jul. 1, 1987

[51] Int. Cl.[4] ..... A42B 3/00; A42B 1/22

[52] U.S. Cl. ..... 2/419; 2/416

[58] Field of Search ..... 2/6, 416, 417, 418, 2/419, 420

[56] References Cited

U.S. PATENT DOCUMENTS

| | | | |
|---|---|---|---|
| 2,665,422 | 1/1954 | Green et al. | 2/416 |
| 2,739,309 | 3/1956 | Frieder et al. | 2/416 |
| 2,741,768 | 4/1956 | Ruggiero | 2/416 |
| 2,796,609 | 6/1957 | Fisher et al. | 2/416 |
| 2,805,419 | 9/1957 | Finken | 2/6 X |
| 2,853,708 | 9/1958 | Austin | 2/416 |
| 2,855,605 | 10/1958 | Aileo | 2/419 |
| 3,110,900 | 11/1963 | Crowdes, Jr. | 2/419 |
| 3,241,154 | 3/1966 | Aileo | 2/419 |
| 3,613,113 | 10/1971 | Aileo | 2/420 |
| 3,613,114 | 10/1971 | Hill et al. | 2/416 |
| 3,619,814 | 11/1971 | Aileo | 2/418 |
| 3,897,596 | 8/1975 | Aileo et al. | 2/6 |
| 3,994,023 | 11/1976 | Aileo et al. | 2/417 |

FOREIGN PATENT DOCUMENTS

| | | | |
|---|---|---|---|
| 998695 | 7/1965 | United Kingdom | 2/420 |

*Primary Examiner*—Wm. Carter Reynolds

*Attorney, Agent, or Firm*—Shenier & O'Connor

[57] ABSTRACT

An adjustable suspension for a helmet or the like in which a front headband portion adapted to extend across the front of the wearer's head and a rear headband portion adapted to extend across the rear of the wearer's head receive an adjustable peripheral strap that extends around the wearer's head to complete the headband. Respective crown straps secured to the headband portions at their lower ends are formed with loops at their upper ends which are interconnected by an adjustable-length cord. A suspension frame contains apertures at spaced locations therearound for receiving the intermediate portions of the crown straps. Each headband portion also receives an adjustable strap that is looped through adjacent apertures in the suspension frame to permit adjustment of the front-to-back spacing of the suspension frame relative to the wearer's head.

20 Claims, 4 Drawing Sheets

HELMET SUSPENSION WITH INTEGRATED CROWN STRAPS AND HEADBAND

BACKGROUND OF THE INVENTION

Our invention relates to a suspension system for a protective helmet or other headgear.

Suspension systems for supporting a protective helmet or the like relative to the head of a wearer are well known in the art. Typical suspension systems of the prior art are shown in Aileo et al U.S. Pat. Nos. 3,897,596 and 3,994,023. In each of the suspensions shown in these patents, a rigid suspension frame is formed with an upwardly opening outer peripheral channel for receiving the lower edge of the shell of the helmet. Straps of a crown structure for receiving the top of the wearer's head are secured to the suspension frame at spaced locations therearound, while pads cooperating with one another to form a peripheral headband are independently secured to the same suspension frame.

Although such suspensions satisfactorily achieve the objects of their invention, certain areas remain for improvement. The need for improved suspensions arises particularly in the case of heavier, ballistic-impact-resistant helmets, which may weigh as much as 65 ounces. These heavier helmets create the need for a suspension system that permits adjustment of the helmet's center of gravity relative to the wearer, as well as providing increased stability and retention of the helmet on the head. Further, the suspension system should minimize pressure points on the head that might cause discomfort. Aside from these requirements arising from the use of heavier ballistic-type helmets, it is also desirable that a suspension system accommodate a range of head sizes and allow easy servicing or replacement of components.

SUMMARY OF THE INVENTION

One object of our invention is to provide a suspension system that is especially suitable for use with heavier, ballistic-impact-resistant helmets.

Another object of our invention is to provide a suspension system that permits adjustment of the helmet's center of gravity relative to the wearer.

A further object of our invention is to provide a suspension system for a helmet that provides increased stability and retention of the helmet on the head.

Still another object of our invention is to provide a suspension system for a helmet or the like that minimizes pressure points on the head.

An additional object of our invention is to provide a suspension system that accommodates a range of head sizes.

A further object of our invention is to provide a suspension system that allows easy servicing or replacement of components.

Other and further objects will be apparent from the following description.

In general, our invention contemplates a headgear assembly in which a suspension frame is formed with means at spaced locations therearound for receiving the intermediate portions of respective crown straps that are interconnected at their upper ends and are secured at their lower ends to a headband. The crown straps are preferably interconnected at their upper ends by an adjustable-length cord that passes through loops formed in the crown straps. The headband preferably extends about the wearer's head and comprises front and rear padded headband portions to which the crown straps are secured and an adjustable-length peripheral strap that is received by the headband portions to complete the headband. Preferably, the front and rear headband portions also carry adjustable-length straps that connect the ends of the headband portions to adjacent portions of the suspension frame to allow adjustment of the helmet shell forwardly or rearwardly on the head of the wearer.

BRIEF DESCRIPTION OF THE DRAWINGS

In the accompanying drawings to which reference is made in the instant specification and which are to be read in conjunction therewith and in which like reference characters are used to indicate like parts in the various views.

DESCRIPTION OF THE PREFERRED EMBODIMENT

Figure 1:
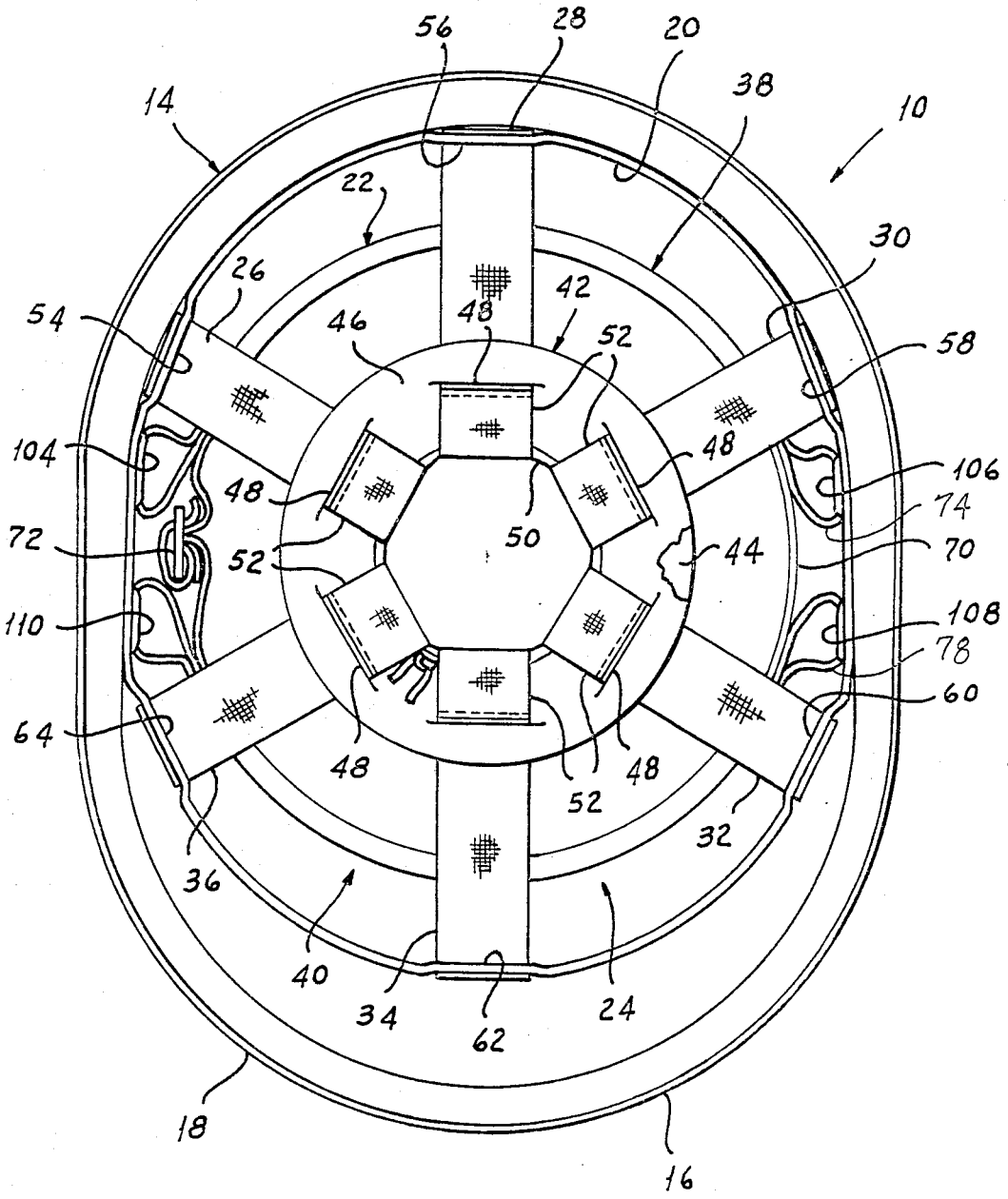
FIG. 1 is a top plan of a helmet suspension embodying our invention with the helmet shell removed and with parts broken away.
Figure 2:
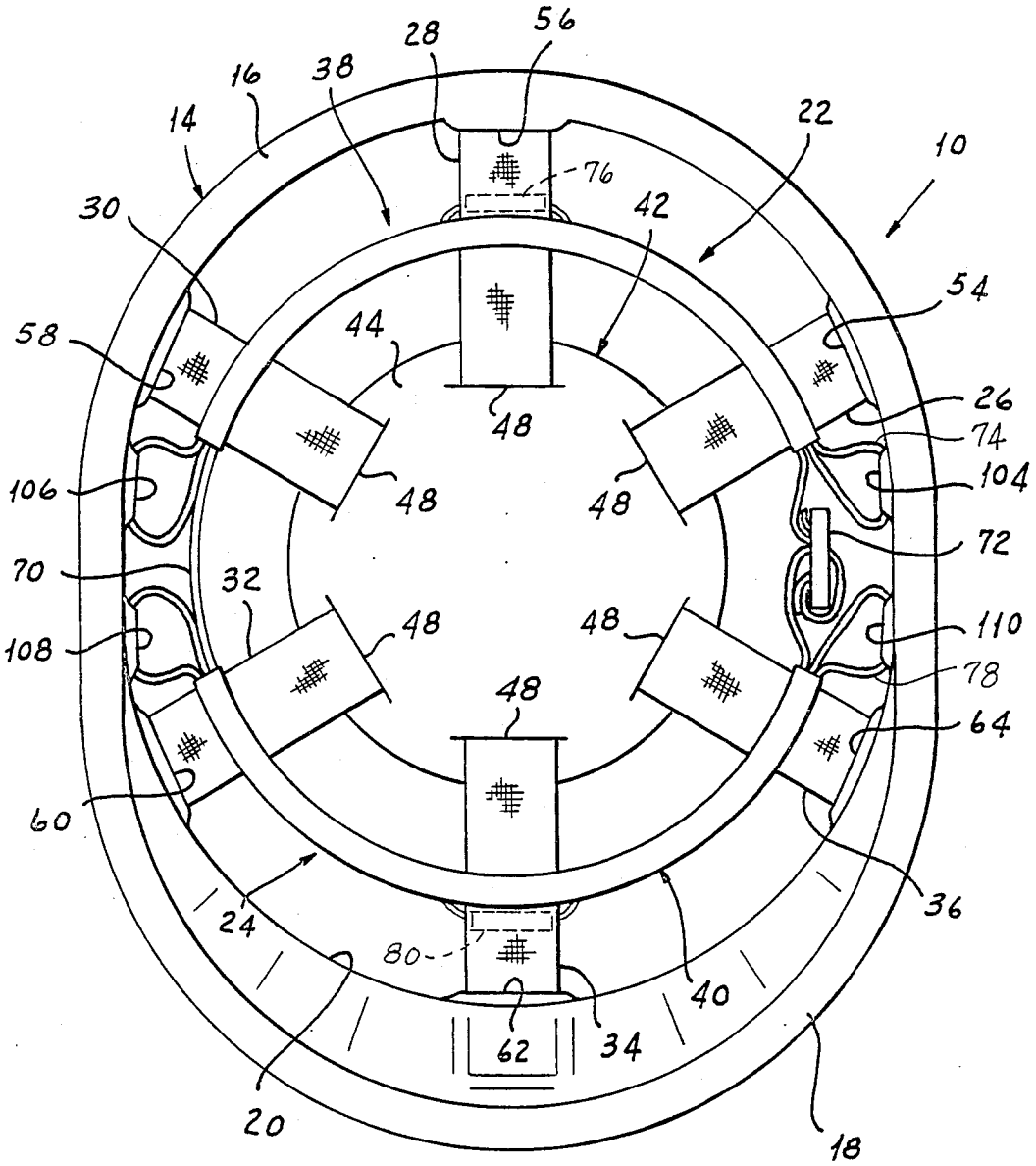
FIG. 2 is a bottom plan of the helmet suspension shown in FIG. 1 with the helmet shell removed.
Figure 3:
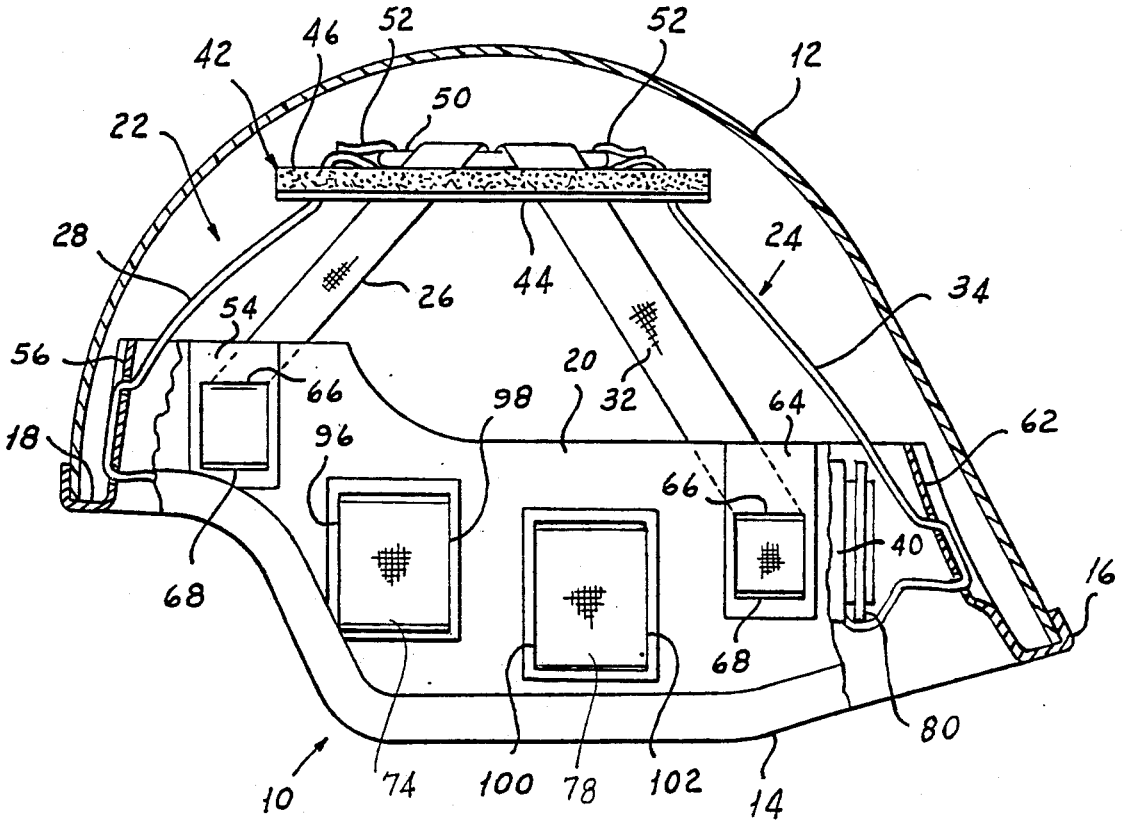
FIG. 3 is a left side elevation of the helmet suspension shown in FIG. 1 with the helmet shell in place and with parts shown in section.
Figure 4:
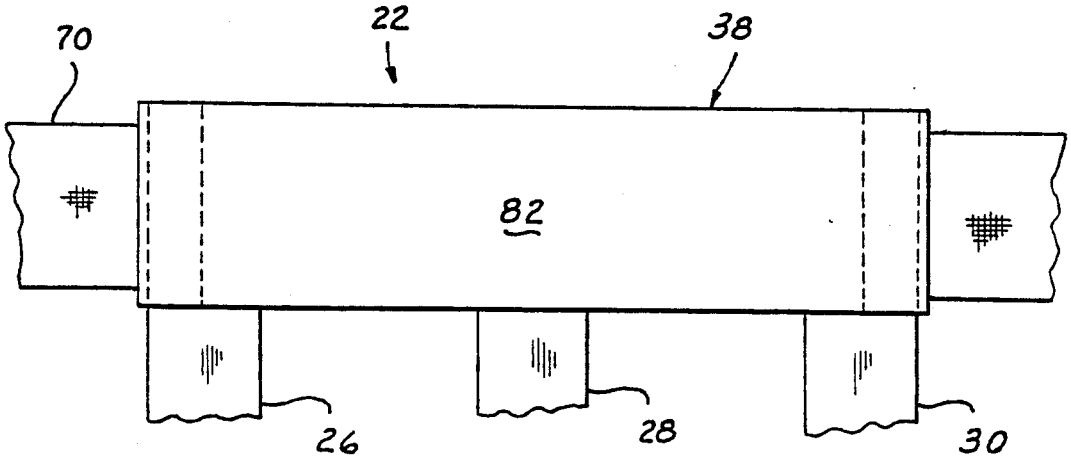
FIG. 4 is an enlarged fragmentary rear elevation of the front band-and-strap subassembly of the suspension shown in FIG. 1.
Figure 5:
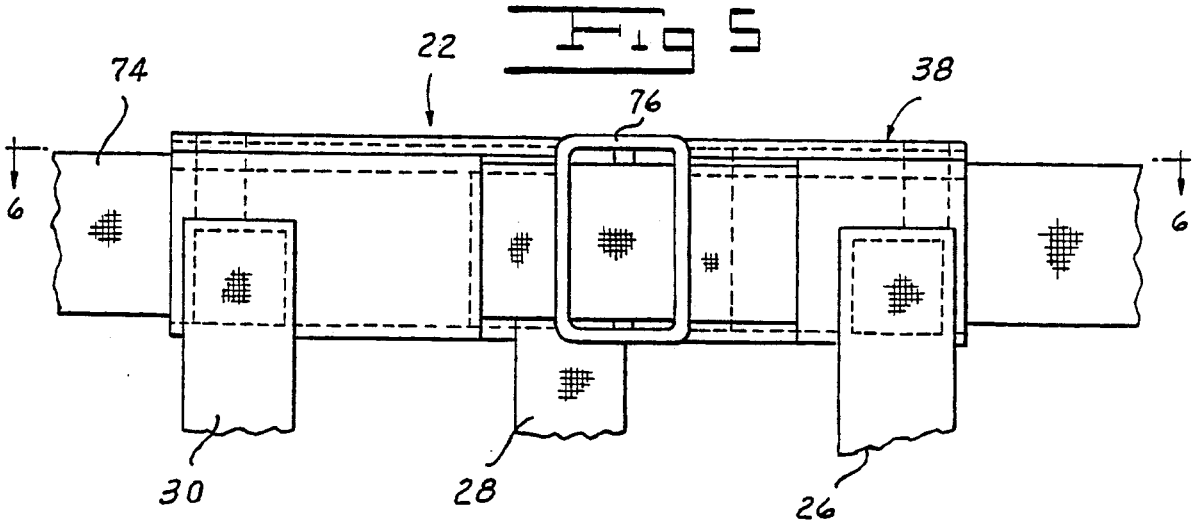
FIG. 5 is an enlarged fragmentary front elevation of the front band-and-strap subassembly of the suspension shown in FIG. 1.
Figure 6:
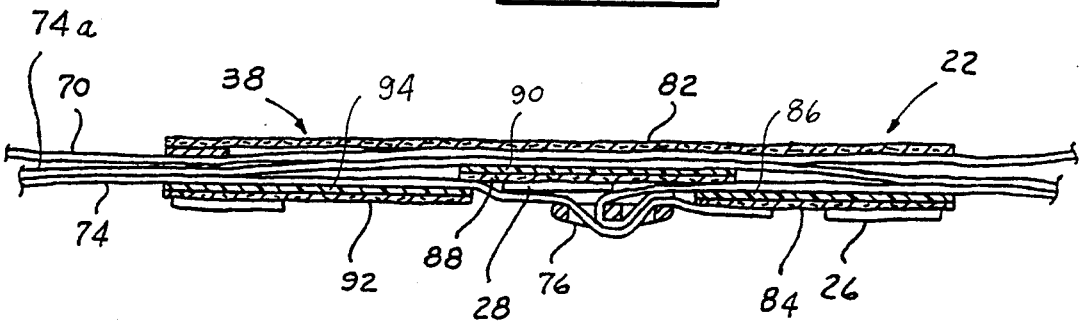
FIG. 6 is an enlarged fragmentary section of the front band-and-strap subassembly of the suspension shown in FIG. 1, taken along line 6—6 of FIG. 5.
Figure 7:
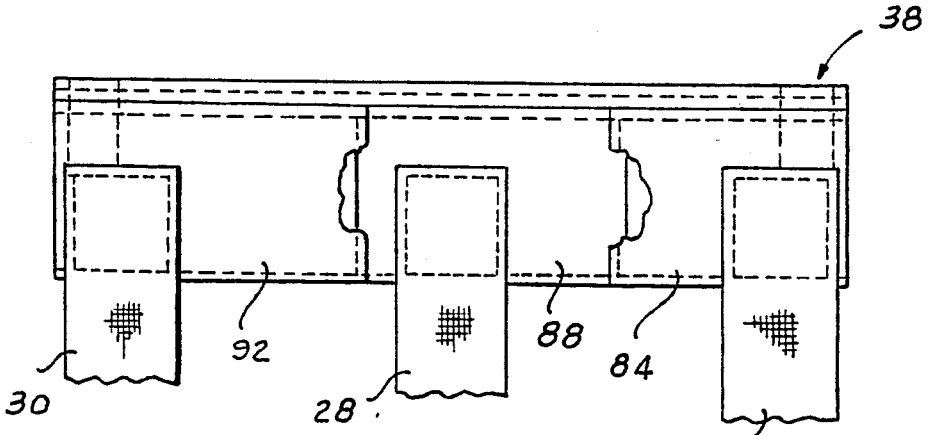
FIG. 7 is an enlarged fragmentary front elevation of the front band-and-strap subassembly of the suspension shown in FIG. 1 with the front and peripheral straps removed and with parts broken away.

Referring first to FIGS. 1 to 3, our suspension, indicated generally by the reference numeral 10, for supporting a rigid helmet shell 12 includes a suspension frame indicated generally by the reference numeral 14. The lower periphery of frame 14 has an upwardly turned portion 16 forming an upwardly opening peripheral channel 18 for receiving the lower peripheral edge of shell 12. Shell 12 may be releasably secured to the suspension frame 14 by any suitable means known to the art, such as the snap fasteners shown in Aileo et al U.S. Pat. Nos. 3,897,596 and 3,994,023. Frame 14 also has a portion 20 extending upwardly from the peripheral channel 18 and inwardly relative to the shell 12 so as to be slightly spaced therefrom.

Suspension 10 includes a front band-and-strap subassembly indicated generally by the reference numeral 22 and an identical rear band-and-strap subassembly indicated generally by the reference numeral 24. Front subassembly 22 comprises a leather pad 38 adapted to extend across the wearer's forehead and respective crown straps 26, 28 and 30 secured to the lower portion of the front surface of pad 38 at spaced locations therealong. In a similar manner, rear subassembly 24 comprises a leather pad 40 adapted to extend across the back of the wearer's head and respective crown straps 32, 34 and 36 secured to the lower portion of the rear surface of pad 40 at spaced locations along its length. Each of crown straps 26 to 36 passes outwardly through a lower slot 68 formed in upwardly extending frame portion 20 and then inwardly through an upper slot 66 formed in the frame portion just above the lower slot 68. Upwardly extending portion 20 is formed with respective indentations 54, 56, 58, 60, 62 and 64 in the region of the slots 66 and 68 so that the portions of straps 26 to 36 passing between slots 66 and 68 remain recessed relative to the general surface contour of frame 14. A crown pad indicated generally by the reference numeral 42 comprises a lower leather lining 44 contacting the wearer's head and a foam cushion 46 covering the lining 44. The upper ends of straps 26 to 36 pass through slits 48 formed at spaced locations about the periphery of crown pad 42 and are interconnected by an adjustable cord 50 extending through loops 52 formed in the upper ends of the crown straps.

Referring now to FIGS. 4 to 7, which show front pad 38, each of pads 38 and 40 comprises an inner leather panel 82 for contacting the head of the wearer and a plurality of outer leather flaps 84, 88 and 92 (proceeding from right to left as viewed in FIGS. 5 to 7) forming passages for straps to be described. Flaps 84, 88 and 92 are provided with elastomeric inner linings 86, 90 and 94, respectively, to reduce friction between the straps to be described and the flaps.

A peripheral headband strap 70, the ends of which are adjustably interconnected by a buckle 72, passes through the channels formed in headband portions 38 and 40 by panels 82, 84, 88 and 92 to form a headband completely encircling the head of the wearer. Strap 70, like crown straps 26 to 36, may comprise any suitable fabric material. Front headband portion 38 also receives a front adjustment strap 74, which passes through pairs of vertical slots 96 and 98 formed on each side of the upwardly extending portion 20 to complete a loop. A buckle 76 adjustably interconnects the ends of front strap 74 in a manner similar to that of buckle 72. As shown in FIGS. 4 to 7, an inner loop portion 74*a* of strap 74 extends through the channel formed in headband portion 38 just outwardly of headband strap 70, while an outer loop portion of strap 74 passes outwardly of center panel 88 to expose buckle 76.

In a similar manner, rear headband portion 40 receives a rear adjustment strap 78 which extends through pairs of vertical slots 100 and 102 formed on either side of upwardly extending frame portion 20 to complete a loop. An adjustment buckle 80 similar to buckle 76 adjustably interconnects the ends of rear adjustment strap 78 at a location adjacent rear crown strap 34 in a manner analogous to that shown for front headband portion 38 in FIGS. 4 to 7. Upwardly extending frame portion 20 is formed with respective left and right front indentations 104 and 106 for recessing slot pairs 96 and 98 and with respective left and right rear indentations 110 and 108 for recessing rear slot pairs 100 and 102.

Loosening or tightening either the front strap 74 or the rear strap 78 shifts the position of the shell 12 on the head forwardly or rearwardly to optimize the positioning of the center of gravity for a particular wearer. Thus, tightening the front strap 74 increases the spacing between front headband portion 38 and the front of frame portion 20, while loosening the front strap allows a closer spacing between these two elements. In a similar manner, tightening the rear strap 78 increases the spacing between rear headband portion 40 and the rear of frame portion 20, while loosening the rear strap 78 achieves the opposite result.

Adjustment of the crown strap cord 50 allows for adjustment of the height of the helmet on the wearer's head. The upward pressure exerted by the wearer's head in reaction to the weight of the shell 12 produces a tension in the upper portions of crown straps 26 to 36. Since the crown straps are free to move through slots 66 and 68 in frame 20, this tension is transmitted to the lower portions of the crown straps secured to headband portions 38 and 40. As a result, crown straps 26 to 36 draw the headband portions downwardly and outwardly toward slots 68, where the lagger-circumference portion of the head is generally located. As more weight is applied to the crown area of the head, the more tightly the headband portions 38 and 40 are drawn to insure stability to the wearer.

Peripheral headband strap 70, which is laced through front and rear headband portions 38 and 40 in the manner described above, equalizes the tension in the front and rear headband portions. Adjustment buckle 72 allows the circumference of the headband formed by strap 70 to be adjusted to that of the head of the wearer. In systems employing headsets (not shown) within shell 12, headband strap 70 may be omitted to allow for proper clearance without interference with the suspension.

It will be seen that we have accomplished the objects of our invention. Our suspension system is especially suitable for use with heavier, ballistic-impact-resistant helmets, and permits adjustment of the helmet's center of gravity relative to that of the wearer. Our suspension system provides increased stability and retention of the helmet on the head while minimizing pressure points. Our suspension system accommodates a wide range of head sizes. Finally, our suspension system allows easy servicing or replacement of components.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. A headgear assembly including in combination a headband, a plurality of crown straps having upper ends and lower ends, means for interconnecting the upper ends of said straps, means for securing the lower ends of said straps to said headband, a suspension frame, and means on said suspension frame for receiving portions of said straps intermediate said upper ends and said headband for movement relative to said frame, the arrangement of said straps being such that tension in the upper portions of said straps is transmitted to the lower portions of said straps to draw said headband toward said receiving means.

2. An assembly as in claim 1 in which the effective lengths of said straps are adjustable.

3. An assembly as in claim 1 in which said straps are formed with loops at their upper ends, said interconnecting means comprising an adjustable-length cord passing through said loops.

4. An assembly as in claim 1 in which said headband includes a padded portion adapted to contact the wearer's head.

5. An assembly as in claim 1 in which said headband is adapted to extend around the wearer's head.

6. An assembly as in claim 5 including means for adjusting the effective circumference of said headband.

7. A headgear assembly including in combination a first headband portion adapted to extend across the front of the wearer's head, a second headband portion adapted to extend across the rear of the wearer's head, a plurality of crown straps having upper and lower ends, means for securing the lower end of each of said crown straps to one of said headband portions, means for interconnecting the upper ends of said crown straps, a suspension frame, and means on said suspension frame for receiving portions of said crown straps intermediate said upper ends and said headband portions for movement relative to said frame, the arrangement of said straps being such that tension in the upper portions of said straps is transmitted to the lower portions of said straps to draw said headband portions toward said receiving means.

8. An assembly as in claim 7 in which the effective lengths of said crown straps are adjustable.

9. An assembly as in claim 7 in which said crown straps are formed with loops at their upper ends, said interconnecting means comprising an adjustable-length cord passing through said loops.

10. An assembly as in claim 7 including means for interconnecting the ends of said headband portions.

11. An assembly as in claim 10 in which said means for interconnecting the ends of said headband portions is adjustable.

12. An assembly as in claim 7 including a peripheral strap adapted to extend around the wearer's head, said headband portions having means for receiving said peripheral strap.

13. An assembly as in claim 12 including means for adjusting the effective circumference of said peripheral strap.

14. An assembly as in claim 13 in which said adjusting means comprises a buckle.

15. An assembly as in claim 7 including means independent of said crown straps for connecting the ends of one of said headband portions to adjacent portions of said suspension frame.

16. An assembly as in claim 15 in which said connecting means is adjustable.

17. An assembly as in claim 15 in which said connecting means comprises a strap received by said headband portion.

18. An assembly as in claim 1 in which said frame is adapted to support a helmet shell, said intermediate strap portions being movable relative to said receiving means with said shell on said frame.

19. An assembly as in claim 7 in which said frame is adapted to support a helmet shell, said intermediate strap portions being movable relative to said receiving means with said shell on said frame.

20. A headgear assembly including in combination a first headband portion adapted to extend across the front of the wearer's head, a second headband portion adapted to extend across the rear of the wearer's head, a peripheral strap adapted to extend around the wearer's head, said headband portions having means for receiving said peripheral strap, a plurality of crown straps having upper and lower ends, means for securing the lower end of each of said crown straps to one of said headband portions, means for interconnecting the upper ends of said crown straps, a suspension frame, and means on said suspension frame for receiving portions of said crown straps intermediate said upper end and said lower ends.

* * * * *

UNITED STATES PATENT AND TRADEMARK OFFICE

CERTIFICATE OF CORRECTION

PATENT NO. : 4,833,735

DATED : May 30, 1989

INVENTOR(S) : Richard J. Long and James J. Petruzella

It is certified that error appears in the above-identified patent and that said Letters Patent is hereby corrected as shown below:

Column 6, line 3 - "12" should read -- 20 --.

Signed and Sealed this

Sixteenth Day of January, 1990

*Attest:*

JEFFREY M. SAMUELS

*Attesting Officer*

*Acting Commissioner of Patents and Trademarks*